US007277361B1

(12) United States Patent
Baba

(10) Patent No.: US 7,277,361 B1
(45) Date of Patent: Oct. 2, 2007

(54) TIMEKEEPING DEVICE

(75) Inventor: Norimitsu Baba, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/656,508

(22) Filed: Jan. 23, 2007

(51) Int. Cl.
*G04F 8/00* (2006.01)
*G04F 10/00* (2006.01)

(52) U.S. Cl. ..... 368/109; 368/110

(58) Field of Classification Search ..... 368/3, 368/107–113
See application file for complete search history.

(56) References Cited

U.S. PATENT DOCUMENTS 4,505,595 A * 3/1985 Rose et al. ..... 368/110
4,637,732 A * 1/1987 Jones et al. ..... 368/109
4,657,405 A * 4/1987 Nakazawa ..... 368/110
4,769,797 A * 9/1988 Murakami ..... 368/111
6,144,620 A * 11/2000 dePoortere ..... 368/108
6,603,711 B2 * 8/2003 Calace ..... 368/109
7,218,216 B1 * 5/2007 Uehran ..... 340/517
2004/0008589 A1 * 1/2004 McMillan et al. ..... 368/223
2005/0135196 A1 * 6/2005 Rund ..... 368/108

FOREIGN PATENT DOCUMENTS

JP 2003-344568 A 12/2003

* cited by examiner

*Primary Examiner*—Vit W Miska
(74) *Attorney, Agent, or Firm*—Global IP Counselors, LLP

(57) ABSTRACT

A timekeeping device enables easily knowing how much playing time has passed and can automatically keep track of time added to compensate for stoppage time. The timekeeping device 1 has a input unit 2, a display unit 3, an alarm unit 5, and a control unit 4. The control unit 4 has a timekeeping unit 41 including a first timer 41A and a second timer 41B, a input control unit 42, a timekeeping control unit 43, a display control unit 44, a alarm control unit 45, and memory 46. The alarm unit 5 outputs a first alarm when the second timer 41B is keeping time and the time kept by the first timer 41A reaches a preset time setting. When the second timer is not keeping time and the time kept by the first timer reaches the preset time, the alarm unit 5 outputs the second alarm.

8 Claims, 15 Drawing Sheets

| | |
|---|---|
| A | TIME DISPLAY MODE (CONT: SECOND HALF STANDBY MODE) |
| B | INVALID (CONT: STOP STOPWATCH) |
| C | START COUNTING STOPPAGE TIME, VIBRATION PATTERN A |
| D | LIGHT DIAL |

FIG.12A

SET TIME AND DATE

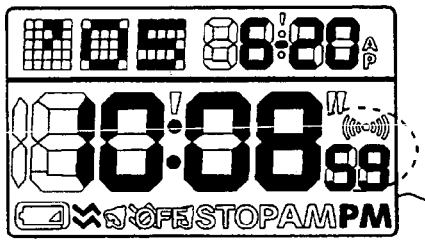

| | |
|---|---|
| A | MINUTE→HOUR→YEAR→ MONTH→DATE→ 12/24 HOUR DISPLAY |
| B | DECREASE SETTING (CONT: QUICK REVERSE) |
| C | INCREASE SETTING (CONT: QUICK FORWARD) |
| D | LIGHT DIAL |

PRESS A BUTTON

FIG.12B

SET 12/24 HOUR TIME DISPLAY

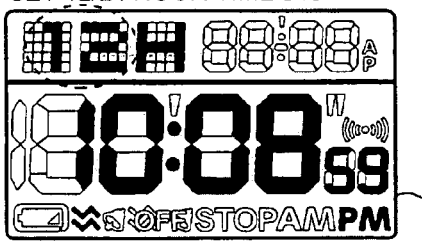

| | |
|---|---|
| A | ADJUST CONTRAST |
| B | SWITCH 12/24 HOUR SETTING |
| C | SWITCH 12/24 HOUR SETTING |
| D | LIGHT DIAL |

PRESS A BUTTON

FIG.12C

ADJUST CONTRAST

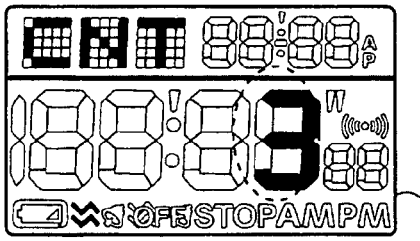

| | |
|---|---|
| A | TIME DISPLAY MODE |
| B | DECREASE CONTRAST |
| C | INCREASE CONTRAST |
| D | LIGHT DIAL |

PRESS A BUTTON

TO TIME DISPLAY MODE

TIMEKEEPING DEVICE

BACKGROUND

1. Technical Field

The present invention relates to a timekeeping device for counting a set time and displaying timekeeping information relating to the measured time.

2. Related Art

During soccer matches and other sports, for example, the referee must keep track of the playing time. In addition to measuring the preset playing time, stoppage time must also be measured in soccer matches in order to add compensatory time and adjust the time at which the match ends. Japanese Unexamined Patent Appl. Pub. JP-A-2003-344568 teaches a stoppage time measuring device that can be used as a referee's stopwatch and can count stoppage time in addition to playing time. This stoppage time measuring device has a first timekeeping means for keeping time by subtracting (counting down) the cumulative time from when the timer is started at the beginning of a match, a second timekeeping means for keeping time by counting down the cumulative time from the start operation and stopping and starting timekeeping in response to a stop/restart operation when the match is interrupted and stoppage time is counted, a time difference calculation means for calculating the difference between the time kept by the first timekeeping means and the time kept by the second timekeeping means as the stoppage time, and a display means for displaying the times kept by the timekeeping means.

A problem with the stoppage time measuring device taught in JP-A-2003-344568 is that it can be difficult for the referee to know how long the match has lasted because the playing time is kept by counting down. This stoppage time measuring device also only handles counting and displaying the stoppage time, and cannot automatically increase the total playing time to account for stoppage time.

SUMMARY

A timekeeping device according to the present invention enables easily knowing the elapsed time and automatically keeping the elapsed time increased by the stoppage time.

A timekeeping device according to a first aspect of the invention has a first timer for starting timekeeping in response to a user operation, keeping time by counting up, and stopping timekeeping in response to a stop operation by the user; a second timer for starting timekeeping in response to a start operation by the user while the first timer is keeping time, keeping time by counting up, and stopping timekeeping in response to a stop operation by the user; a display means for displaying the times kept by the first timer and the second timer; and an alarm unit for issuing at least a first alarm and a second alarm. The alarm unit issues the first alarm when the second timer is keeping time and the time kept by the first timer reaches a preset set time, and issues the second alarm when the second timer is not keeping time and the time kept by the first timer reaches a preset set time, and when the second timer is keeping time and the time kept by the first timer reaches a time equal to the preset set time plus the time kept by the second timer.

By keeping time by counting up, that is, by increasing the time, the first timer and second timer make it easier to know how much time has passed since the timer was started when compared with a count-down timer that keeps time by gradually decreasing from a set time (such as 45 minutes) to zero. A soccer referee, for example, using the timekeeping device according to the present invention can therefore easily know how long the match has lasted and the timekeeping device is thus easier to use.

If an injury happens during a soccer match, for example, the time that the match is paused is kept as stoppage time and an amount of time determined by the cumulative stoppage time may be added after the end of the regulation period. By providing a second timer separately from the first timer, this aspect of the invention uses the second timer to keep track of this stoppage time separately from the playing time that is kept by the first timer. If the second timer counts stoppage time (of 6 minutes, for example), the alarm unit issues the first alarm when the first timer counts to the set playing time (such as 45 minutes) to which the first timer is set, and then issues the second alarm when the first timer reaches the total of this preset set time plus the time counted by the second timer, which in this example is the set playing time of 45 minutes plus stoppage time of 6 minutes for a total of 51 minutes. A soccer referee, for example, thus knows from the first alarm that the preset playing (half) time has been reached and that play has entered stoppage time, and knows from the second alarm when the end of the added stoppage time has been reached. Because the match time is automatically increased by adding the stoppage time and the timer automatically signals when the added time has ended, the referee's job is made significantly easier compared with using a stopwatch that requires the referee to manually adjust the match time to reflect the added stoppage time, and the timekeeping device is therefore particularly convenient. Furthermore, because the end of the set regulation play is signaled using the second alarm when there is no stoppage time, the referee easily knows when the time is up in the same way as when stoppage time is added.

The timekeeping device according to another aspect of the invention has an input unit that is operated by the user; the display unit described above; the alarm unit described above; and a control unit having a timekeeping unit including the first timer and the second timer described above, an input control unit for detecting input to the input unit, a timekeeping control unit for controlling driving the first timer and the second timer based on input from the input control unit, a display control unit for controlling driving the display unit, an alarm control unit for controlling driving the alarm unit, and a storage unit for storing at least the set time that is set by input to the input unit. The alarm control unit controls driving the alarm unit to output the first alarm when the second timer is keeping time and the time kept by the first timer reaches a preset set time, and controls driving the alarm unit to output the second alarm when the second timer is not keeping time and the time kept by the first timer reaches a preset set time, and when the second timer is keeping time and the time kept by the first timer reaches a time equal to the preset set time plus the time kept by the second timer.

Further preferably, the first timer can keep a preset first half playing time and a second half playing time, starts counting the first half playing time from 0 minute 0 second, and starts counting the second half playing time from the end of the first half playing time.

More specifically, when a timekeeping control unit for controlling driving the first timer and second timer is provided, the timekeeping control unit sets the first timer to the previously set first half playing time and causes the first timer to start timekeeping by counting up from this first half playing time when a command to start counting the second half playing time is asserted.

If the first half playing time is set to 45 minutes and the second half playing time is also set to 45 minutes for a soccer match, for example, the first timer keeps time in the first half by counting up from 0:00, and keeps time in the second half by counting up from 45:00, which is the end of first half regulation play in this example. If stoppage time occurs in the first half and time is therefore added to the first half so that the first timer counts up to 51 minutes before ending the first half, for example, the first timer is first reinitialized to the first half playing time or 45:00 minutes in this example and then counts up when started to keep the second half playing time.

When the first timer is used to keep time for the first and second halves, the timer could also start counting up from 0:00 in the second half. However, the cumulative playing time during both the first half and second half can be more easily known by starting timekeeping for the second half from the end of the preset first half playing time (45 minutes in this example). As a result, if a foul occurs at 25 minutes into the second half of a game played with 45 minute halves and the first timer is restarted from 0:00 in the second half, the referee must record that the penalty occurred in the second half after 25 minutes into the second half, or add the 45 minutes of the first half to this 25 minutes to record a penalty in the 70-th minute of play. Because the time kept by the first timer is displayed cumulatively and shows 70 minutes in this example, the invention enables the referee to simply record that a penalty occurred after 70 minutes of play, and convenience is thus improved.

Further preferably the alarm unit enables selecting whether the alarm is output from a buzzer or a vibrator.

More specifically, when an alarm control unit for controlling driving the alarm is provided, both a buzzer and a vibration motor can be rendered in the alarm unit, and the alarm control unit can selectively drive either the buzzer or vibration motor.

The buzzer in this aspect of the invention can be driven to emit an audible alarm so that the user can easily recognize the alarm without needing to look at the timekeeping device. The vibration motor can also issue a vibrating alarm that can be felt by the user so that the user can still easily recognize the alarm without looking when spectator cheering, for example, makes hearing the audible alarm difficult.

Further preferably, the alarm unit outputs an alarm when the time kept by the first timer reaches a predetermined time before the set time.

More specifically, when an alarm control unit for controlling driving the alarm unit is provided, the alarm control unit can drive the alarm unit when the time kept by the first timer reaches a preset predetermined time before the set time.

During a soccer match when time is added to the normal first half or second half playing time for stoppage time, the center referee may need to inform a fourth referee how much time is added. If a reminder alarm is set to issue three minutes or five minutes, for example, before the end of regulation play, the referee can reliably signal to the other referees that time will be added.

Further preferably, the timekeeping device also has a voice input unit for voice input and a voice recognition unit for recognizing the voice input, and starting and stopping timekeeping by the timers is based on voice input.

Because this arrangement enables operating the timer by voice control, there is no need to operate buttons, for example, and operation is therefore improved.

Yet further preferably, the timekeeping device also has a voice input unit for voice input, and a voice recognition unit for recognizing the voice input, and when a team name, player jersey number, and penalty type are input by voice input, the information input by voice is stored together with the time indicated by the first timer when the voice input was detected.

Because this arrangement enables operating the timer by voice control, there is no need to operate buttons, for example, and operation is therefore improved. The referee's job is also made easier because the type of penalty, such as a yellow card and red card in the case of soccer, and the offending player's jersey number can be recorded by voice and the referee therefore does not need to record the penalty on a note card during the game, for example.

Yet further preferably, the timekeeping device also has a card reading unit for reading an IC card, and the time indicated by the first timer when a predetermined card is read is stored together with the card information when the predetermined card is read.

This arrangement enables using IC cards for the yellow and red penalty cards used in soccer, for example, and enables the referee to record a penalty by simply swiping the penalty card over the card reading unit. The referee's job is thus made easier because the referee does not need to record the penalty on a note card during the game, for example.

As described above, a timekeeping device according to the invention enables easily knowing the elapsed time and automatically keeping the elapsed time increased by the stoppage time.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 12 shows an example of adjusting the time in the first embodiment of the invention.

DESCRIPTION OF EMBODIMENTS

First Embodiment

Arrangement of the Timekeeping Device

Figure 1:
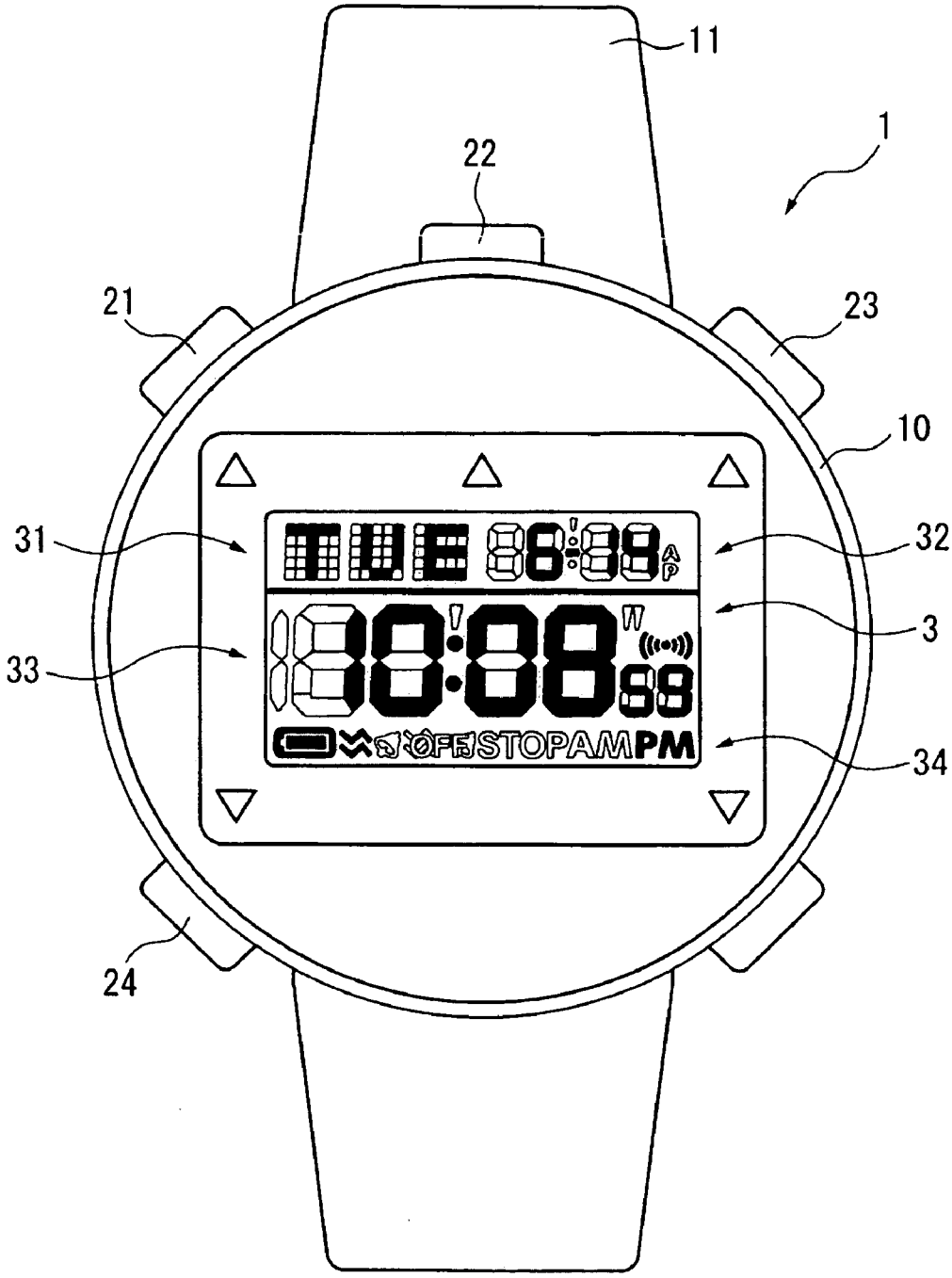
FIG. 1 is a front view of a timekeeping device according to a first embodiment of the invention.

FIG. 1 is a front view of a timekeeping device 1 according to the present invention. This timekeeping device 1 is a wristwatch type device having a timekeeping unit 10 and a wristband 11 so that the timekeeping device 1 can be used worn on the wrist by a soccer referee, for example.

Figure 2:
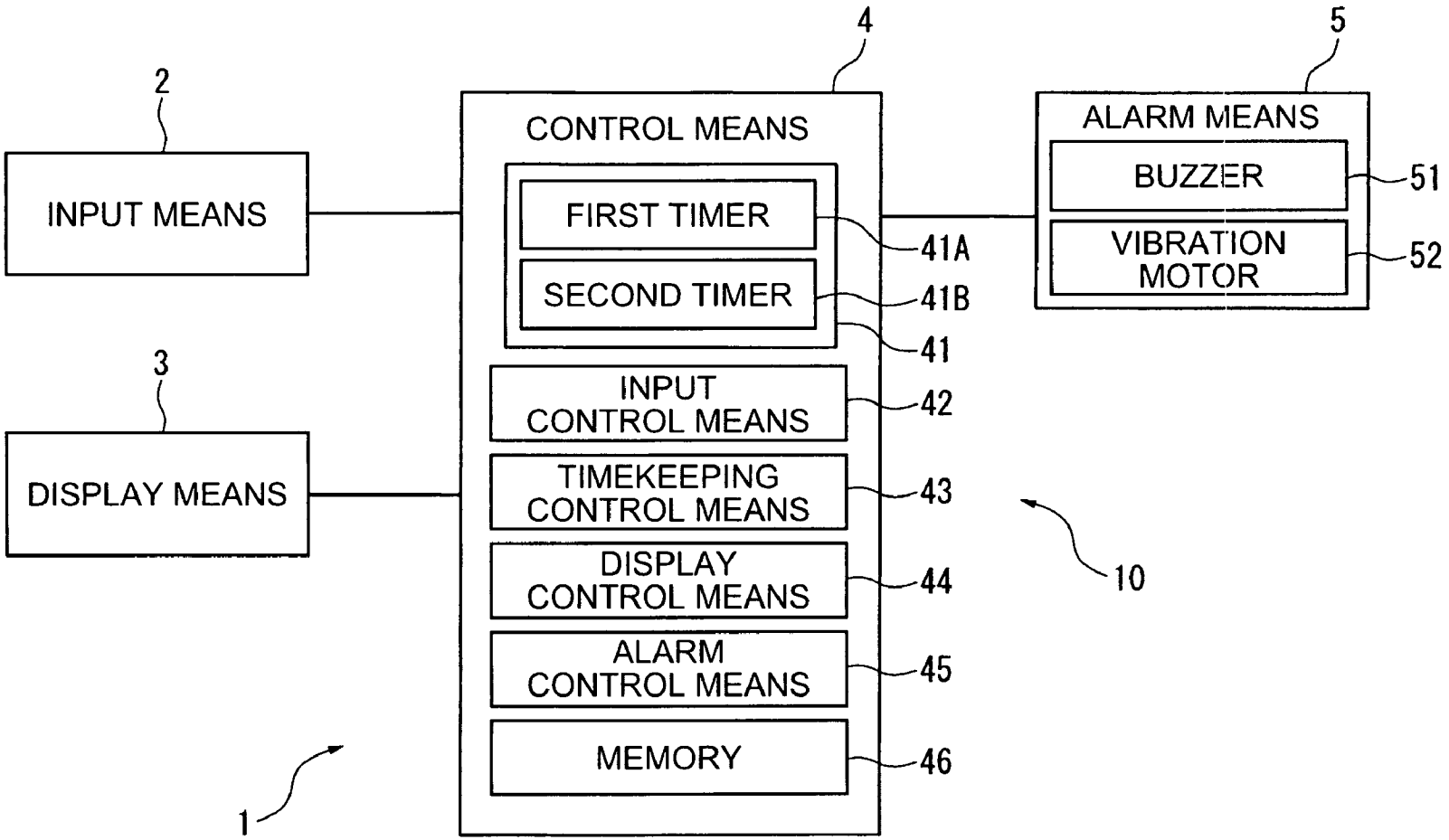
FIG. 2 is a block diagram of a timekeeping device according to a first embodiment of the invention.

The timekeeping unit 10 is basically round when seen from the front and is sized so that the timekeeping unit 10 can be worn on the wrist. The timekeeping unit 10 measures and displays stoppage time and the match time (playing time) that is set by the user. The timekeeping unit 10 therefore has an input unit 2, a display unit 3, a control unit 4, and an alarm unit 5 as shown in FIG. 2.

The input unit 2 has buttons for setting the time kept by the stopwatch and starting and stopping timekeeping, recognizes operations by the user, which is assumed to be a referee in this aspect of the invention, and outputs operating signals to the control unit 4. As shown in FIG. 1, the input unit 2 in this embodiment of the invention includes a first button (A button) 21, a second button (B button) 22, a third button (C button) 23, and a fourth button (D button) 24.

As shown in FIG. 1 the A button 21, the B button 22, and the C button 23 are disposed along the top part of the timekeeping unit 10, and the D button 24 is disposed at a bottom part of the timekeeping unit 10. The locations of these buttons are not limited to the arrangement shown in FIG. 1, and the buttons can be located anywhere on the timekeeping unit 10 that the buttons can be operated. The operations that are triggered by pressing these buttons 21 to 24 differ according to the operating mode of the timekeeping unit 10, and are therefore further described below.

As shown in FIG. 1, the display unit 3 is located on the face of the timekeeping device 1, and is controlled by the control unit 4 to display information that is input and set by the user, and display the stopwatch time that is kept by the timekeeping unit of the control unit 4 as further described below. In this embodiment of the invention the display unit 3 is a liquid crystal display device.

Figure 3:
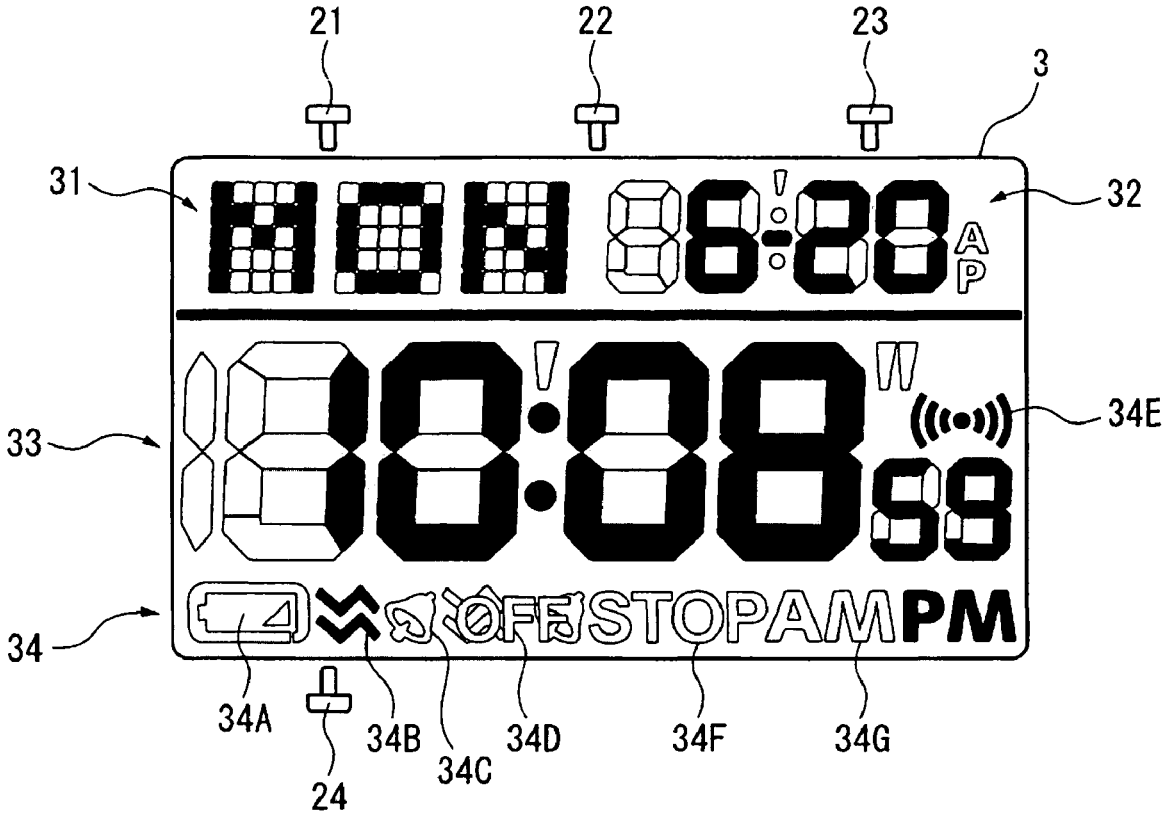
FIG. 3 is a front view of the display unit of the timekeeping device according to a first embodiment of the invention.

As shown in FIG. 3, the display unit 3 has first through fourth display units 31, 32, 33, and 34. The first display unit 31 is located at the top left part of the LCD and displays the day of the week, for example. The second display unit 32 is located at the top right part of the LCD and displays the current time, for example. The third display unit 33 is located in the middle of the LCD and displays the stopwatch time. The fourth display unit 34 is located at the bottom of the LCD and displays operating state information. The specific content displayed in the first to fourth display units 31, 32, 33, and 34 differs according to the operating state of the timekeeping unit 10 as further described below.

The first display unit 31 is a dot matrix display unit for displaying numbers and letters. The second display unit 32 and third display unit 33 are seven-segment displays, for example, for displaying primarily numbers. The fourth display unit 34 is composed of icons indicating various operating states. More specifically, the fourth display unit 34 includes a battery icon 34A, a vibration icon 34B, a buzzer icon 34C, a silence icon 34D, a one-time alarm icon 34E, a STOP icon 34F, and an AM/PM icon 34G indicating morning and afternoon.

Timekeeping Device Control Unit

The control unit 4 of the timekeeping device 1 is described next.

FIG. 2 is a schematic block diagram showing the control arrangement of the timekeeping device 1 (timekeeping unit 10). The control unit 4 is rendered using a CPU (central processing unit) device, takes operating signals output from the input unit 2, and runs a predetermined control program stored in memory 46 based on the input operating signals. As shown in FIG. 2 the control unit 4 includes a timekeeping unit 41, an input control unit 42, a timekeeping control unit 43, a display control unit 44, an alarm control unit 45, and memory 46 as a storage unit.

The timekeeping unit 41 is controlled by the timekeeping control unit 43 and keeps time based on a clock signal output from a clock signal generator not shown, for example. As shown in FIG. 2, the time keeping unit 41 has two timers 41A and 41B that are controlled by the timekeeping control unit 43. The first timer 41A counts up to the stopwatch time set by the user, that is, sequentially increments the time kept from 0 seconds. If the timekeeping device 1 is used in a soccer match, for example, the timekeeping device 1 keeps the match time set by the user. More specifically, if the match time is 90 minutes including two 45-minute halves, the stopwatch time is set to 90 minutes. If the match has two 40-minute halves for a total match time of 80 minutes, the stopwatch time is set to 80 minutes.

The second timer 41B counts up the time between when the user starts the timekeeping operation of the timer and stops the timekeeping operation (referred to below as simply starting and stopping the stopwatch). If the timekeeping device 1 is used in a soccer match, for example, the second timer 41B keeps track of stoppage time during the match. If stoppage time is measured plural times during the first half, the second timer 41B keeps the cumulative stoppage time while stoppage time is being counted. When the first half ends and the first timer 41A resumes timekeeping at the start of the second half, the second timer 41B is simultaneously reinitialized so that the second timer 41B measures the stoppage time only during the second half. The timers 41A and 41B output signals corresponding to the kept time to the timekeeping control unit 43, the display control unit 44, and the alarm control unit 45.

The input unit 2 outputs an operating signal to the input control unit 42 when one of the buttons 21 to 24 is operated, and the input control unit 42 changes the operating mode or outputs a specific signal to the timekeeping control unit 43, display control unit 44, or alarm control unit 45 according to the input signal.

The timekeeping control unit 43 controls driving the timekeeping unit 41 based on signals output from the input control unit 42, data and a control program stored in the memory 46, and signals output from the timers 41A and 41B.

The display control unit 44 controls driving the display unit 3 based on signals output from the input control unit 42, a control program and data stored in memory 46, and signals output from the timers 41A and 41B.

The alarm control unit 45 controls driving the alarm unit 5 based on signals output from the input control unit 42, a control program and data stored in memory 46, and signals output from the timers 41A and 41B.

The control operation of the control unit 4 is described in further detail below.

The memory 46 stores the time kept by the first timer 41A, the time kept by the second timer 41B, and control programs for the different operating modes. The memory 46 also stores settings information input from the input unit 2 as controlled by the input control unit 42. This settings information includes the countdown time of the first timer 41A and selection information denoting the selected operating state of the buzzer 51 and vibration motor 52 set by the input unit 2.

The alarm unit 5 is controlled by the alarm control unit 45 and tells the user by unit of sound or vibration when the countdown time that is being counted reaches the set time. As shown in FIG. 2 this alarm unit 5 has a buzzer 51 and a vibration motor 52. The arrangement of the buzzer 51 and vibration motor 52 are known from the literature and detailed description thereof is thus omitted.

Controlling the Timekeeping Device

Figure 4:
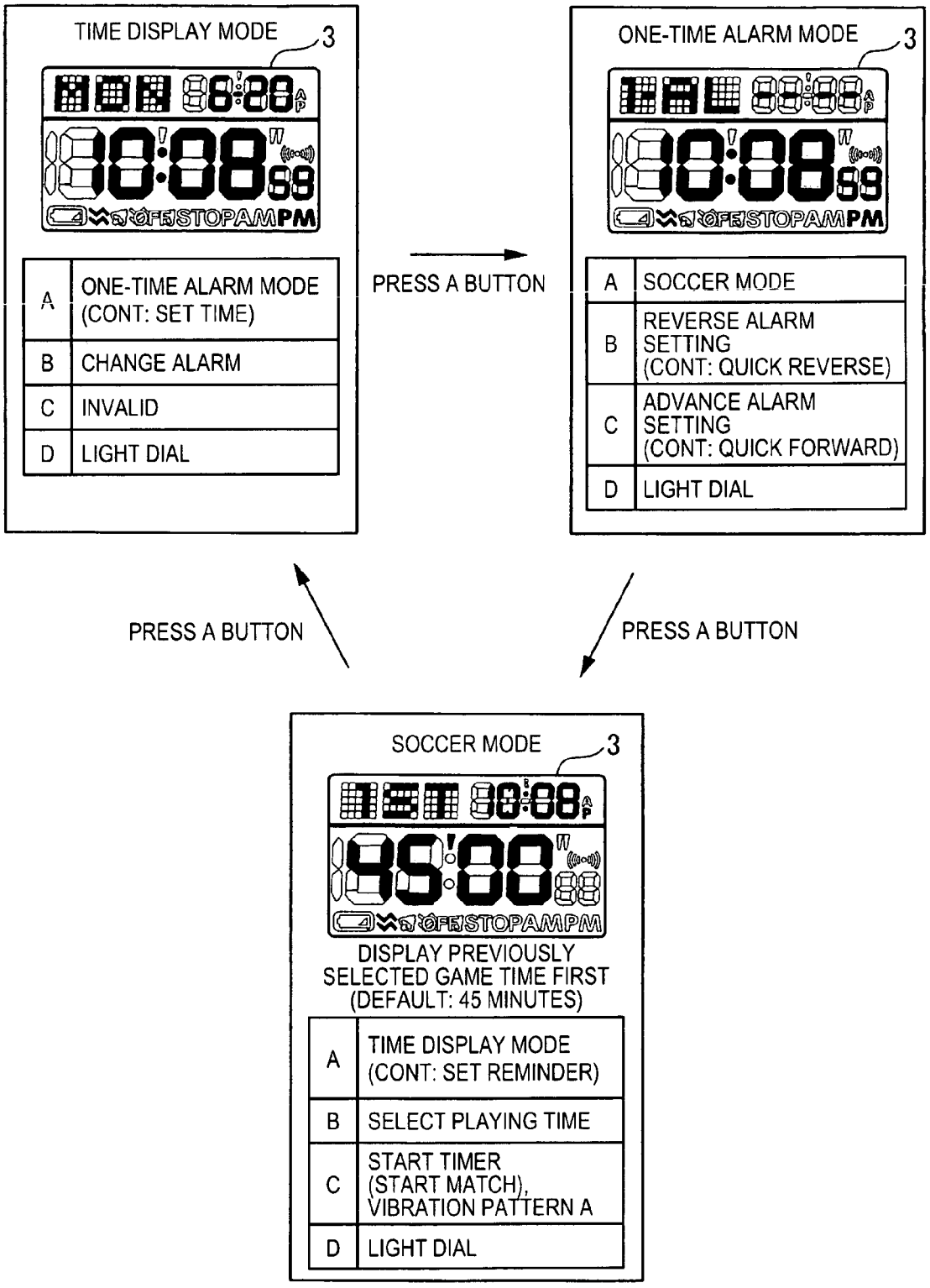
FIG. 4 describes changing the operating mode of the timekeeping device.

The control operation of the control unit 4 is described next. FIG. 4 describes changing the operating and display mode of the timekeeping device 1. Note that in the figures and below pressing and holding a button depressed (denoted "CONT" in the figures) unit that the button is pressed and held in the depressed state for a predetermined time such as two seconds or longer.

Clock Mode

In the clock mode an abbreviation such as MON, TUE, and so forth denoting the day of the week is displayed in the first display unit 31, the date, such as "6-20" denoting June 20, is displayed in the second display unit 32, the time including the hour, minute, and second is displayed in the third display unit 33, and the icon denoting "AM" for the morning or "PM" for the afternoon, for example, is displayed in the fourth display unit 34.

Pressing the A button 21 when in the clock mode changes to the one-time alarm mode. In addition, holding the A button 21 depressed for a predetermined time or longer, such as two seconds or more, changes to the time setting mode to adjust the time. Pressing the B button 22 cycles the alarm mode sequentially through the vibration mode using the vibration motor 52, the buzzer mode using the buzzer 51, a silent mode, and back to the vibration mode and so forth in a loop. Pressing the D button 24 in the clock mode turns the display light on. An electroluminescent backlight is used in this embodiment of the invention, and pressing the D button 24 turns the backlight on. The C button 23 has no function in the clock mode, and nothing happens when the C button 23 is pressed.

One-Time Alarm Mode

When the A button 21 is pressed in the clock mode to enter the one-time alarm mode, the symbol "1-AL" denoting the one-time alarm mode is displayed in the first display unit 31. Nothing is displayed in the second display unit 32 when in the one-time alarm mode, but the time (hour, minute, second) is displayed in the third display unit 33 and the icon denoting "AM" for the morning or "PM" for the afternoon, for example, is displayed in the fourth display unit 34.

In this time display mode pressing the A button 21 enters the "soccer mode." Pressing the B button 22 reverses the alarm setting to an earlier time to set the alarm time. Pressing and holding the B button 22 rapidly reverses the alarm setting to an earlier time. Pressing the C button 23 advances the alarm setting and pressing and holding the C button 23 rapidly advances the alarm setting. Pressing the D button 24 illuminates the dial (that is, turns the backlight on).

Soccer Mode (Stopwatch Mode)

When the soccer mode is set by pressing the A button 21 in the one-time alarm mode, the information described below is displayed in the display units 31 to 34 depending on what buttons are pressed.

Pressing the A button 21 in the soccer mode changes to the time display mode, and pressing and holding the A button 21 enters the reminder alarm setup mode. Pressing the B button 22 selects the match time. Each time the B button 22 is pressed the set match time increments five minutes in a continuous cycle from 5 minutes to 10 minutes, 15 minutes, 20 minutes, 25 minutes, 30 minutes, 35 minutes, 40 minutes, 45 minutes, and back to 5 minutes. When the A button 21 is pressed in the one-time alarm mode to enter the soccer mode, the previously selected match time is displayed first.

Pressing the C button 23 starts the stopwatch (starts the match) and causes the alarm to sound using vibration pattern A. Pressing the D button 24 turns the electroluminescent backlight on.

Note that in this embodiment of the invention the alarm is set to the vibration mode and the vibration icon 34B is displayed. When the alarm is set to sound according to a specific vibration pattern when one of the buttons is pressed, the alarm sounds in one of vibration patterns A to D.

Operation in the Soccer Mode

Operation in the soccer mode is described next. This example considers three patterns: no stoppage time in the first half, no stoppage time in the second half, and counting stoppage time.

Operation with No Stoppage Time in the First Half

Operation when there is no stoppage time in the first half, the match time is set to 45 minute halves, and the reminder is set to 5 minutes is described first.

First Half Standby Mode

When the soccer mode is entered the timekeeping device 1 enters the first half standby mode waiting for the first half to start. More specifically, "1ST" indicating the first half is displayed in the first display unit 31 of the display unit 3 as shown in FIG. 5A, the current time is displayed in the second display unit 32, and the previously selected time of each half is displayed in the third display unit 33.

Figures 5A, 5B, 5C:
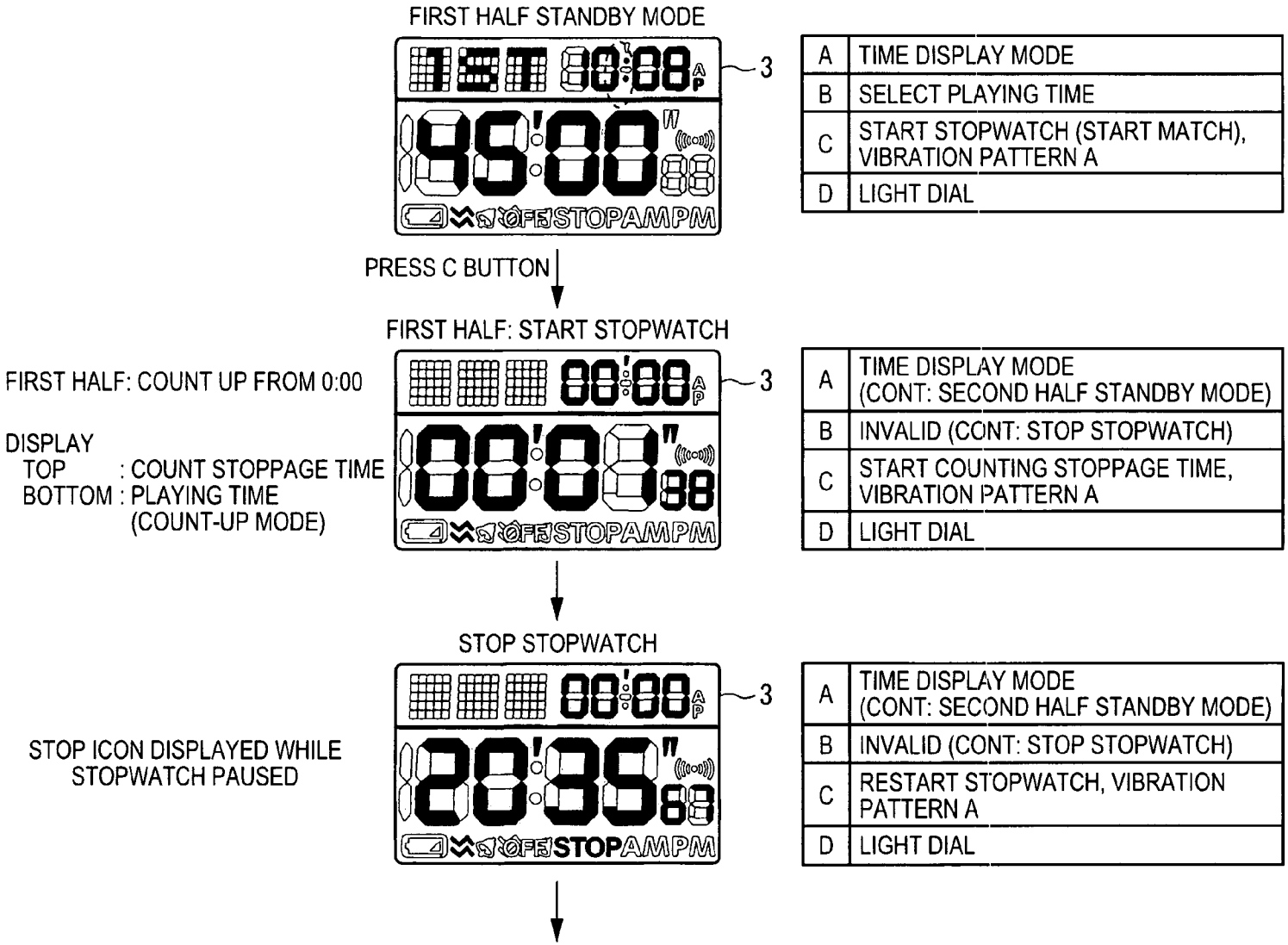
FIG. 5 shows an example of timekeeping by the first embodiment of the invention.

Pressing buttons 21 to 24 in the first half standby mode to start causes the mode transitions shown in FIG. 5A. More specifically, pressing the A button 21 enters the time display mode, pressing the B button 22 selects the match time, pressing the C button 23 starts the timer (stopwatch) and simultaneously causes the alarm to sound using vibration pattern A to inform the user that the C button 23 was pressed. Pressing the D button 24 turns the electroluminescent backlight on.

First Half Starts: Start Timer

Pressing the C button 23 in the first half standby mode starts the first half timer as shown in FIG. 5B. More specifically, the first timer 41A starts keeping time and the time kept by the first timer 41A is displayed in the third display unit 33. Because the first timer 41A keeps time in a count-up mode, the time displayed in the third display unit 33 increases sequentially from the start time of 0:00:00. The time kept by the second timer 41B is also displayed in the second display unit 32, but because the second timer 41B does not keep time when there is no stoppage time, the time displayed in the second display unit 32 remains 00:00.

Pressing the A button 21 returns to the time display mode, and continuing to hold the A button 21 depressed enters the second half standby mode. Pressing the B button 22 once has no effect, but pressing and holding the B button 22 asserts a stop timer command and the first timer 41A stops. Pressing the C button 23 starts keeping stoppage time and causes the alarm to sound using vibration pattern A. Pressing the D button 24 turns the electroluminescent backlight on.

Timer Stops

Pressing and holding the B button 22 after the first half starts and the stopwatch is running stops the timer as shown in FIG. 5C. More specifically, timekeeping by the first timer 41A stops and the time at which timekeeping stopped is displayed in the third display unit 33. "STOP" is also displayed in the fourth display unit 34 while the timer is stopped.

Pressing the A button 21 when the timer is stopped enters the time display mode, and pressing and holding the A button 21 enters the second half standby mode. The B button 22 is disabled. Pressing the C button 23 starts the timer and causes the alarm to sound using vibration pattern A. Pressing the D button 24 turns the electroluminescent backlight on.

Reminder Alarm

When a reminder is set as further described below and shown in FIG. 6A, a warning is issued at the set time while the timer continues counting. If the set time is 5 minutes, for example, the reminder is issued 5 minutes before the first half ends. The reminder alarm uses vibration pattern B.

First Half Ends

Figures 6A, 6B, 6C:
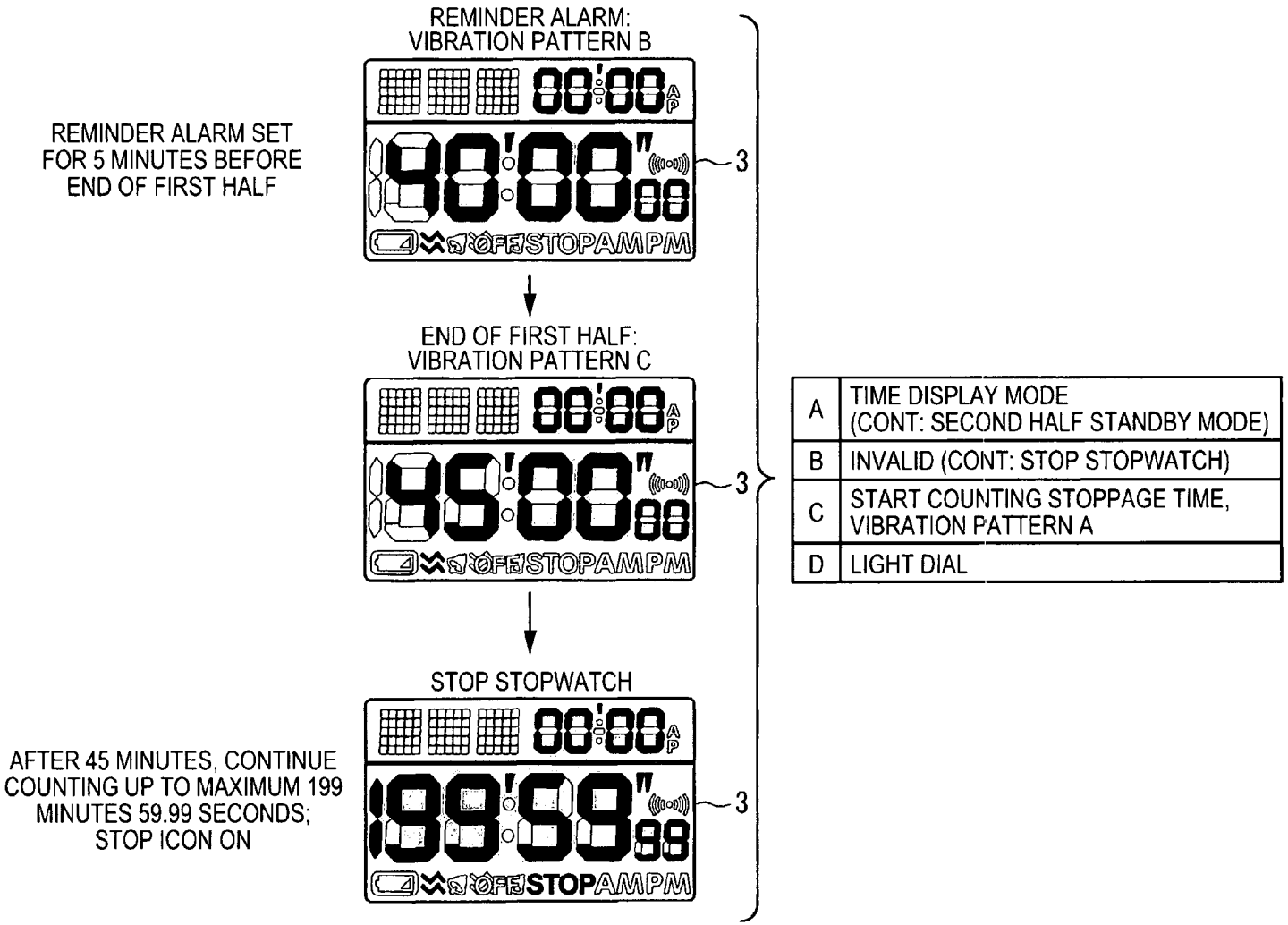
FIG. 6 shows an example of timekeeping by the first embodiment of the invention.

When the first timer 41A counts to the time set as the length of the first half as shown in FIG. 6B and the first half reaches the regulation time, an alarm signalling the end of the first half sounds. This end-of-half alarm uses a specific vibration pattern C. Note, however, that the first timer 41A continues to keep time until the B button 22 is pressed to stop the timer.

Timer Stops

When the B button 22 is pressed and held while the first timer 41A is keeping time, the first timer 41A stops and the stopwatch stops as shown in FIG. 6C. The time at which the timer was stopped is therefore displayed in the third display unit 33, and STOP is displayed in the fourth display unit 34 while the timer is stopped. Note that the first timer 41A and third display unit 33 can count to a maximum time of 199 minutes 59.99 seconds.

The buttons function in the states shown in FIG. 6 in the same way as when the timer is started as shown in FIG. 5B. That is, pressing the A button 21 starts the time display mode, and pressing and holding the A button 21 goes to the second half standby mode. Pressing the B button 22 once does nothing, but pressing and holding the B button 22 asserts a stop timer command and the first timer 41A stops. Pressing the C button 23 starts keeping stoppage time and causes the alarm to sound using vibration pattern A. Pressing the D button 24 turns the electroluminescent backlight on.

Operation with No Stoppage Time in the Second Half

Operation when there is no stoppage time in the second half is described next. Note that the match time is set to 45 minute halves and the reminder is set to 5 minutes as in the above example when there is no stoppage time in the first half.

Second Half Standby Mode

Figures 7A, 7B, 7C:
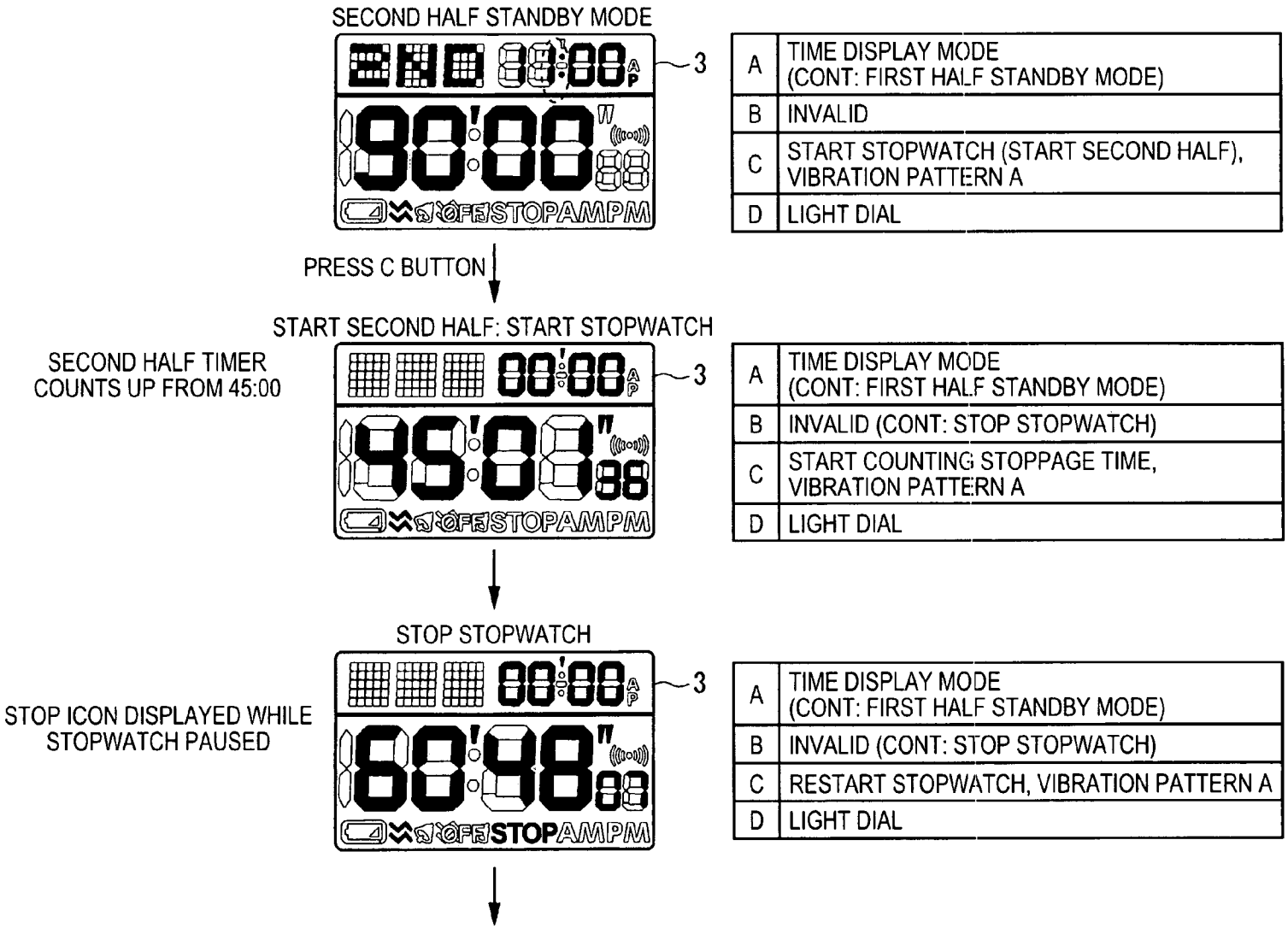
FIG. 7 shows an example of timekeeping by the first embodiment of the invention.

When the A button 21 is pressed and held in the operating states shown in FIG. 5 and FIG. 6, "2ND" indicating the second half of the match is displayed in the first display unit 31 of the display unit 3 as shown in FIG. 7A. The current time is displayed in the second display unit 32. The match time, which is the combined time of the first and second halves (90 minutes if each half is 45 minutes), is displayed in the third display unit 33.

Pressing buttons 21 to 24 in the second half standby mode to start causes the mode transitions shown in FIG. 7A. More specifically, pressing the A button 21 once enters the time display mode and pressing and holding the A button 21 goes to the first half standby mode. The B button 22 is disabled. Pressing the C button 23 starts the timer (stopwatch) to start the second half and simultaneously causes the alarm to sound using vibration pattern A. Pressing the D button 24 turns the electroluminescent backlight on.

Second Half Starts: Start Timer

Pressing the C button 23 in the second half standby mode starts the second half timer as shown in FIG. 7B. More specifically, the first timer 41A starts keeping time and the time kept by the first timer 41A is displayed in the third display unit 33. In the second half the first timer 41A starts counting up from the prescribed end time of the first half. Because the length of each half is set to 45 minutes in this example, the first timer 41A therefore starts counting up from 45 minutes and the time displayed in the third display unit 33 increases sequentially from 45:00:00. The time kept by the second timer 41B is also displayed in the second display unit 32, but because the second timer 41B does not keep time when there is no stoppage time, the time displayed in the second display unit 32 remains 00:00.

Pressing the A button 21 returns to the time display mode, and continuing to hold the A button 21 depressed enters the first half standby mode. Pressing the B button 22 once has no effect, but pressing and holding the B button 22 asserts a stop timer command and the first timer 41A stops. Pressing the C button 23 starts keeping stoppage time and causes the alarm to sound using vibration pattern A. Pressing the D button 24 turns the electroluminescent backlight on.

Timer Stops

Pressing and holding the B button 22 after the second half starts and the stopwatch is running stops the timer as shown in FIG. 7C. More specifically, timekeeping by the first timer 41A stops and the time at which timekeeping stopped is displayed in the third display unit 33. "STOP" is also displayed in the fourth display unit 34 while the timer is stopped.

Pressing the A button 21 when the timer is stopped enters the time display mode, and pressing and holding the A button 21 enters the first half standby mode. The B button 22 is disabled. Pressing the C button 23 starts the timer and causes the alarm to sound using vibration pattern A. Pressing the D button 24 turns the electroluminescent backlight on.

Reminder Alarm

When a reminder is set as further described below and shown in FIG. 8A, a warning is issued at the set time while the timer continues counting. If the set time is 5 minutes, for example, the reminder is issued 5 minutes before the second half ends, which in this example is when the first timer 41A counts up to 85 minutes. The reminder alarm uses vibration pattern B.

Second Half Ends

Figures 8A, 8B, 8C:
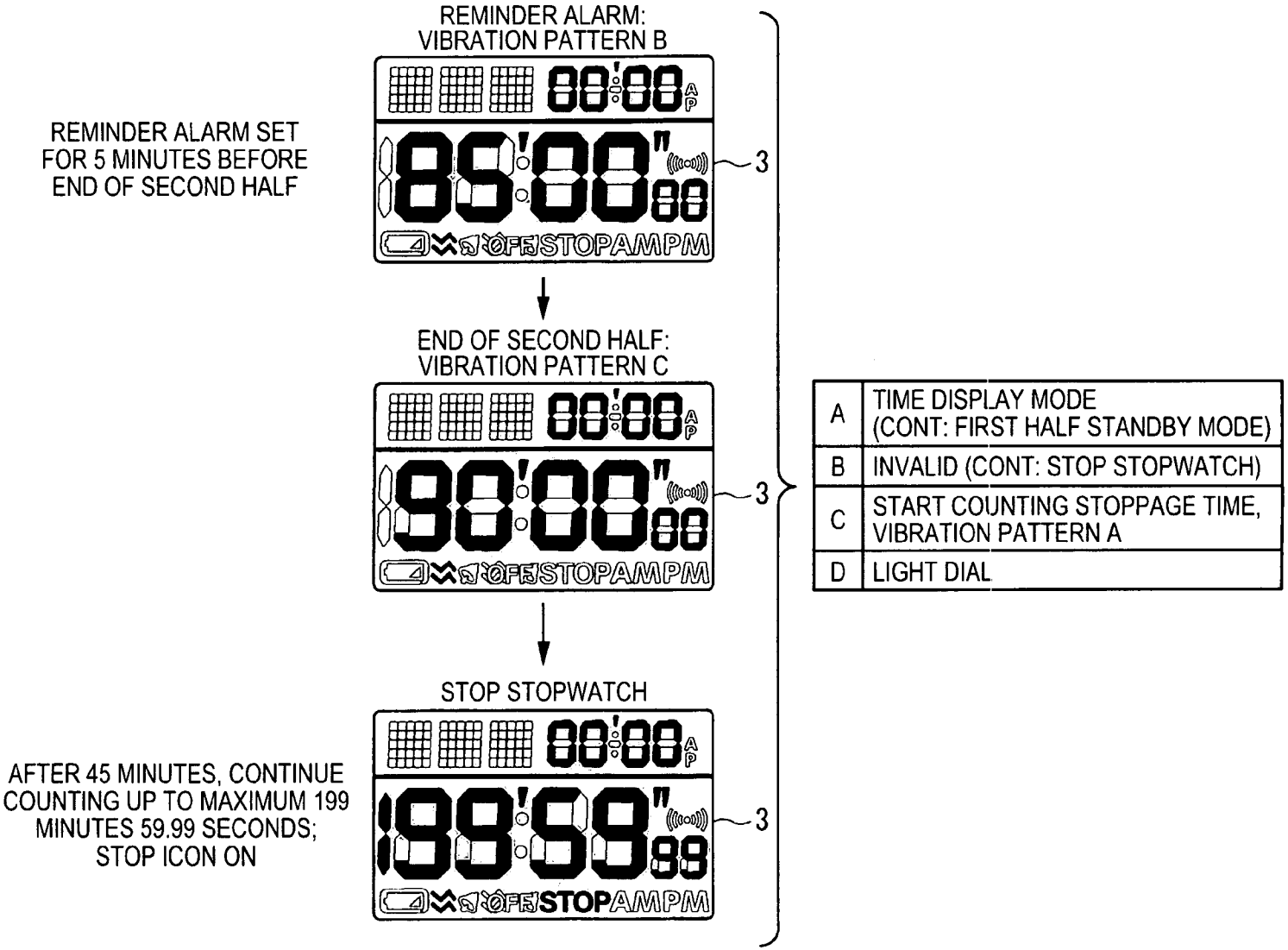
FIG. 8 shows an example of timekeeping by the first embodiment of the invention.

When the first timer 41A counts to the time set as the length of the match, which is 90 minutes in this example, as shown in FIG. 8B and the second half reaches the regulation time, an alarm signalling the end of the second half sounds. This end-of-half alarm uses a specific vibration pattern C. Note, however, that the first timer 41A continues to keep time until the B button 22 is pressed to stop the timer.

Timer Stops

When the B button 22 is pressed and held while the first timer 41A is keeping time, the first timer 41A stops and the stopwatch stops as shown in FIG. 6C. The time at which the timer was stopped is therefore displayed in the third display unit 33, and STOP is displayed in the fourth display unit 34 while the timer is stopped.

The buttons function in the states shown in FIG. 8 in the same way as when the timer is started as shown in FIG. 7B. That is, pressing the A button 21 starts the time display mode, and pressing and holding the A button 21 goes to the first half standby mode. Pressing the B button 22 once does nothing, but pressing and holding the B button 22 asserts a stop timer command and the first timer 41A stops. Pressing the C button 23 starts keeping stoppage time and causes the alarm to sound using vibration pattern A. Pressing the D button 24 turns the electroluminescent backlight on.

Counting Stoppage Time

The operation for counting stoppage time when operating in the soccer mode is described next.

Figures 9A, 9B, 9C:
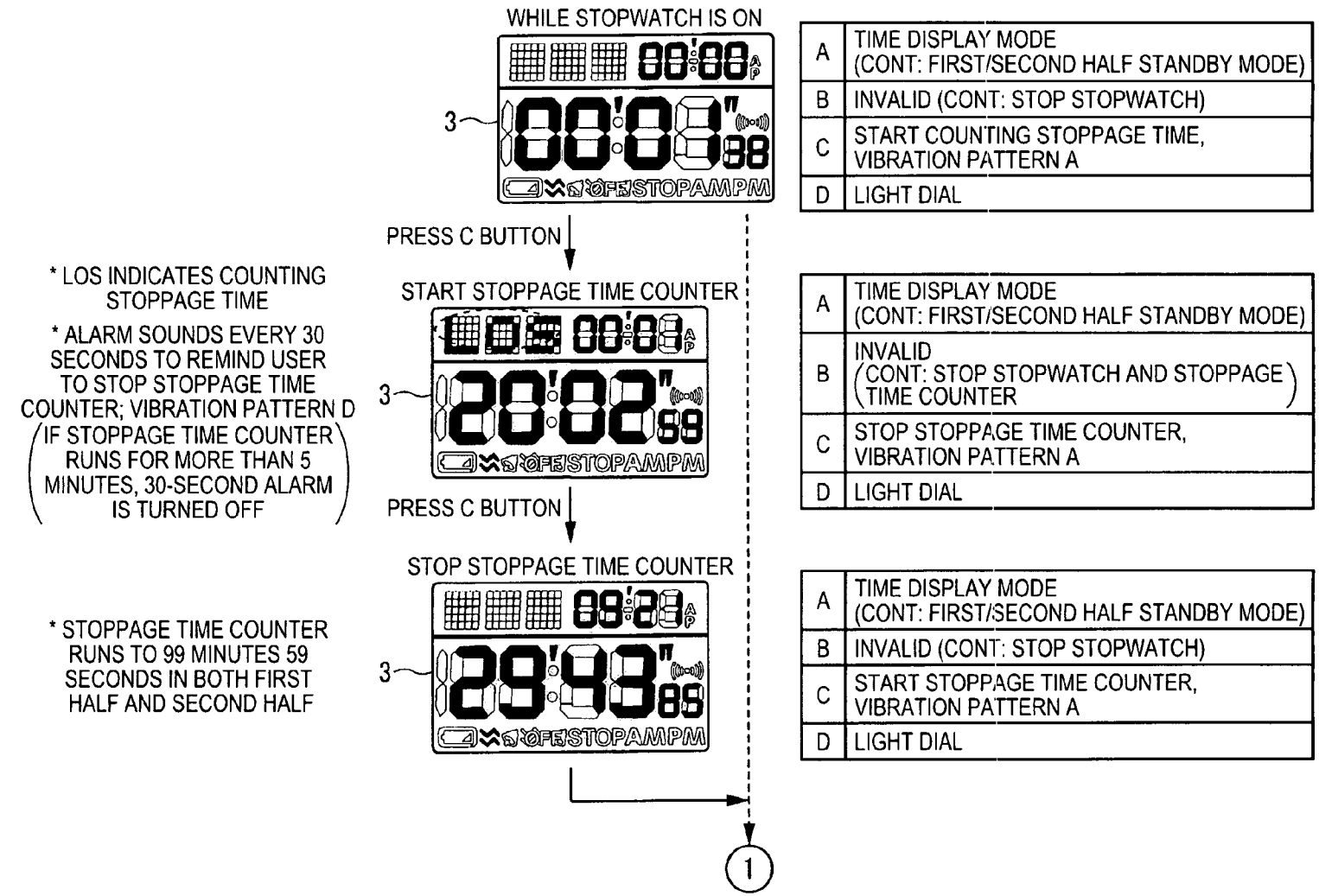
FIG. 9 shows an example of timekeeping by the first embodiment of the invention.

As shown in FIG. 9A, pressing the C button 23 while the timer is operating starts counting stoppage time. When counting the stoppage time starts "LOS" (for "lost time") flashes in the first display unit 31 of the display unit 3 to indicate that stoppage time is being counted as shown in FIG. 9B. When the second timer 41B starts counting stoppage time, the stoppage time counted by the second timer 41B is displayed in the second display unit 32. The first timer 41A also continues keeping time and the time kept by the first timer 41A continues to be displayed in the third display unit 33.

So that the user does not forget to stop counting stoppage time when play resumes, an alarm can be set to sound every 30 seconds while the stoppage time is being counted. When this stoppage time warning is set the alarm sounds every 30 seconds using vibration pattern D. If five minutes pass after counting stoppage time starts, the warning alarm that sounds every 30 seconds stops because stoppage time of more than five minutes is rare.

Pressing the A button 21 starts the time display mode, and pressing and holding the A button 21 goes to the first half or second half standby mode. Pressing the B button 22 once does nothing, but pressing and holding the B button 22 asserts a stop timer command causing the second timer 41B to stop counting the stoppage time and the first timer 41A to stop counting the match time. Pressing the C button 23 stops keeping stoppage time and causes the alarm to sound using vibration pattern A. Pressing the D button 24 turns the electroluminescent backlight on. Stoppage time can be counted to a maximum 99 minutes 59 seconds in both the first half and second half.

Stopping Counting Stoppage Time

Pressing the C button 23 while keeping the stoppage time stops counting the stoppage time as shown by the display in FIG. 9C. More specifically, the second timer 41B stops keeping the stoppage time and the cumulative stoppage time is displayed in the second display unit 32. The first timer 41A continues keeping the match time and the cumulative match time is displayed in the third display unit 33 in the standard count-up method.

Added Playing Time (Stoppage Time)

Figures 10A, 10B, 10C:
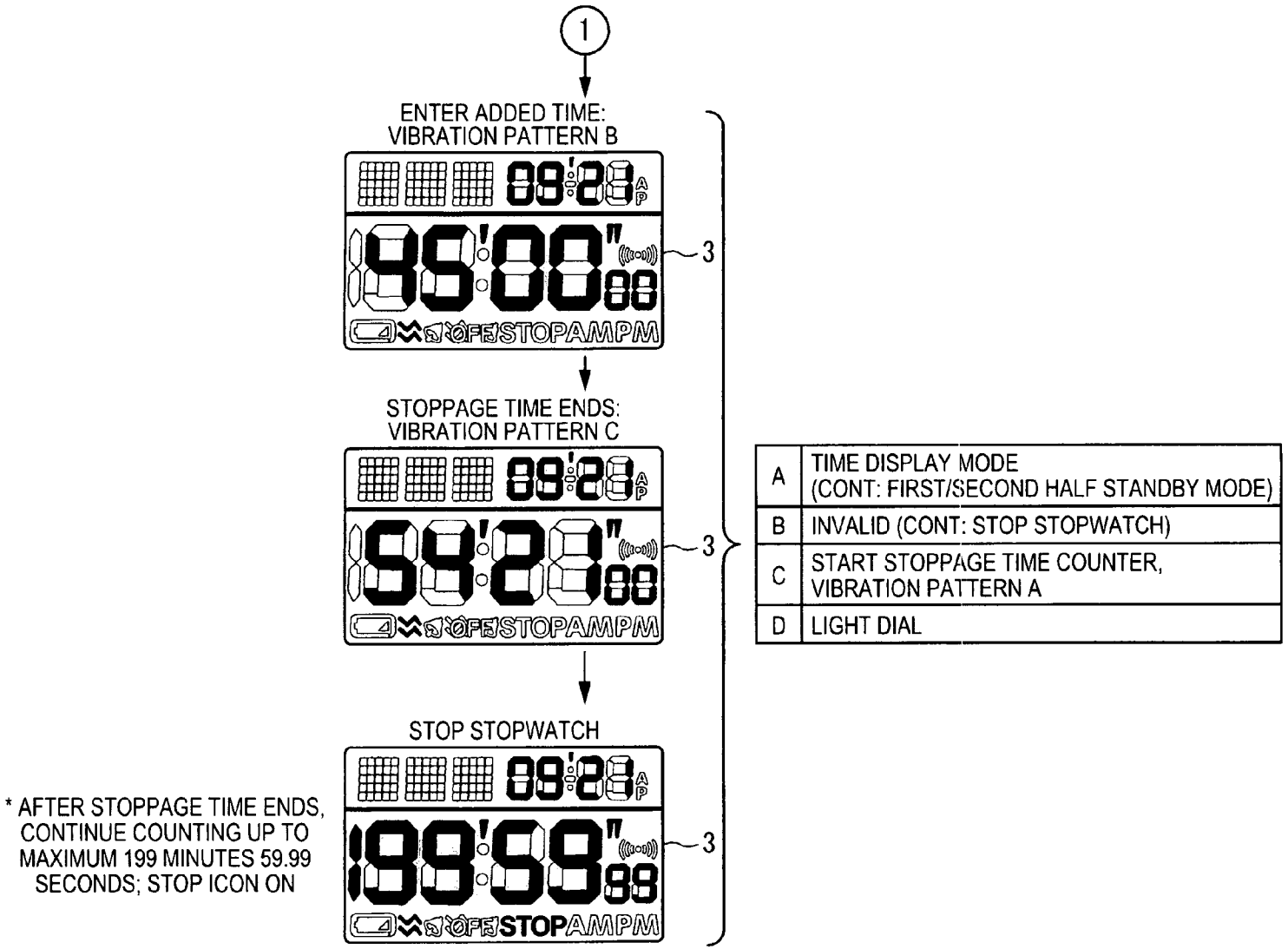
FIG. 10 shows an example of timekeeping by the first embodiment of the invention.

When the time kept by the first timer 41A exceeds the set match time (such as 45 minutes in this example), play continues in added time as shown in FIG. 10A to allow for stoppage time. The alarm also sounds using vibration pattern B to inform the user that stoppage time has been entered.

End of Added Time

When the stoppage time measured by the second timer 41B passes after entering added (stoppage) time, the alarm sounds using vibration pattern C to inform the user that play including stoppage time is over. If the accumulated stoppage time is 9:21, for example, stoppage time ends when playing time reaches 54:21, which is the regulation time of 45 minutes plus stoppage time of 9:21, and the alarm sounds using vibration pattern C.

Timer Stops

When the B button 22 is then pressed and held, the first timer 41A stops and the stopwatch stops. While the first timer 41A continues keeping time during stoppage time play, pressing the A button 21 once goes to the time display mode and pressing and holding the A button 21 goes to the first half or second half standby mode as shown in FIG. 10. Pressing the B button 22 once does nothing, but pressing and holding the B button 22 asserts a stop timer command and the first timer 41A stops. Pressing the C button 23 starts keeping stoppage time and causes the alarm to sound using vibration pattern A. Pressing the D button 24 turns the electroluminescent backlight on.

Setting the Reminder Alarm

Pressing and holding the A button 21 after entering the soccer mode goes to the reminder alarm setup mode. The reminder alarm warns the referee at a preset time before the end of the prescribed play in the first or second half that the half is about to end. When the center referee learns from the reminder alarm function that the half is about to end, the center referee can use hand signals, for example, to inform another referee how much stoppage time will be added.

Figure 11:
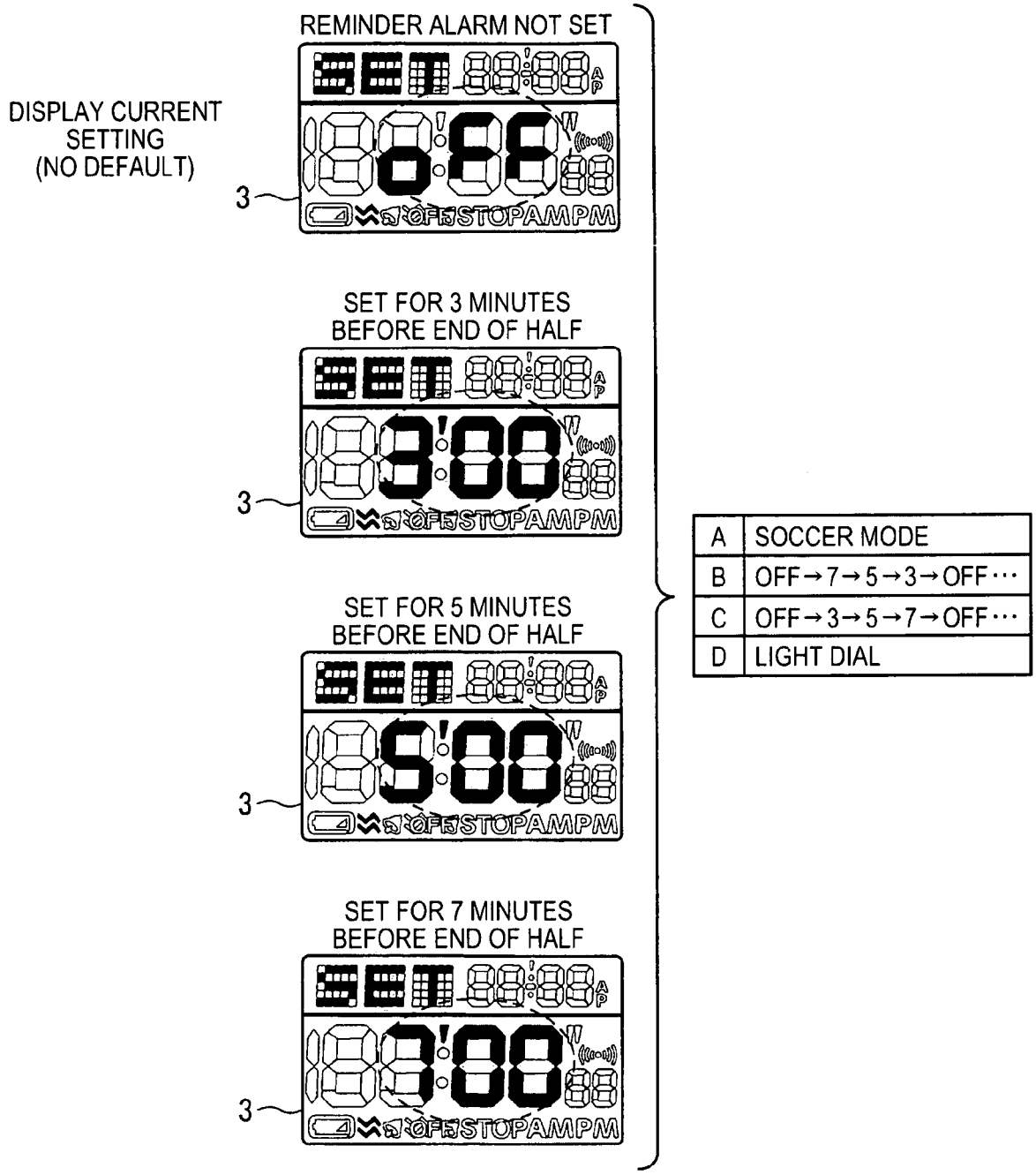
FIG. 11 shows an example of setting the reminder time in the first embodiment of the invention.

More specifically, when the reminder alarm setup mode is set as shown in FIG. 11, "SET" is displayed on the first display unit 31 and the current setting is displayed in the third display unit 33. At the initial default setting the reminder alarm is turned off, and "OFF" is displayed using the numeric third display unit 33.

Pressing the B button 22 then sequentially changes the reminder time in a continuous loop from OFF to 7 minutes, 5 minutes, 3 minutes, and back to OFF with the third display unit 33 changing simultaneously to indicate the reminder time. Pressing the C button 23 sequentially changes the reminder time in a continuous loop from OFF to 3 minutes, 5 minutes, 7 minutes, and back to OFF with the third display unit 33 changing simultaneously to indicate the reminder time. After thus selecting the desired reminder time, pressing the A button 21 returns to the soccer mode with the alarm set to sound a reminder at the displayed reminder time before the end of the half. Pressing the D button 24 turns the electroluminescent backlight on.

Setting the Time

Pressing and holding the A button 21 in the time display mode enters the adjustment mode for setting the current time. The seconds unit is adjusted first upon entering the adjustment mode, and the A button 21 is then pressed to sequentially cycle through the minute, hour, year, month, date, 12/24 hour display mode, display contrast, and time display mode.

In the time/date adjustment mode the year is displayed in the first display unit 31, the month and date in the second display unit 32, the hour, minute, and second in the third display unit 33 as shown in FIG. 12A, and the unit currently selected for adjustment blinks. Pressing the B button 22 once decrements the selected unit by one, and pressing and holding the B button 22 causes the unit to decrease rapidly. Pressing the C button 23 once increments the selected unit by one, and pressing and holding the C button 23 causes the unit to increase rapidly.

When the 12/24 hour selection mode is enabled pressing either the B button 22 or C button 23 toggles the setting between a 12-hour time display and a 24-hour time display. Either "12H" or "24H" is displayed in the first display unit 31 to indicate the mode selected by either button 22 or 23.

In the contrast adjustment mode shown in FIG. 12C "CNT" is displayed in the first display unit 31 and a value indicating the contrast level is displayed in the third display unit 33. Pressing the B button 22 decreases the contrast and pressing the C button 23 increases the contrast.

Pressing the D button 24 when adjusting any of the adjustment units turns the electroluminescent backlight on.

One-Time Alarm

Figure 13:
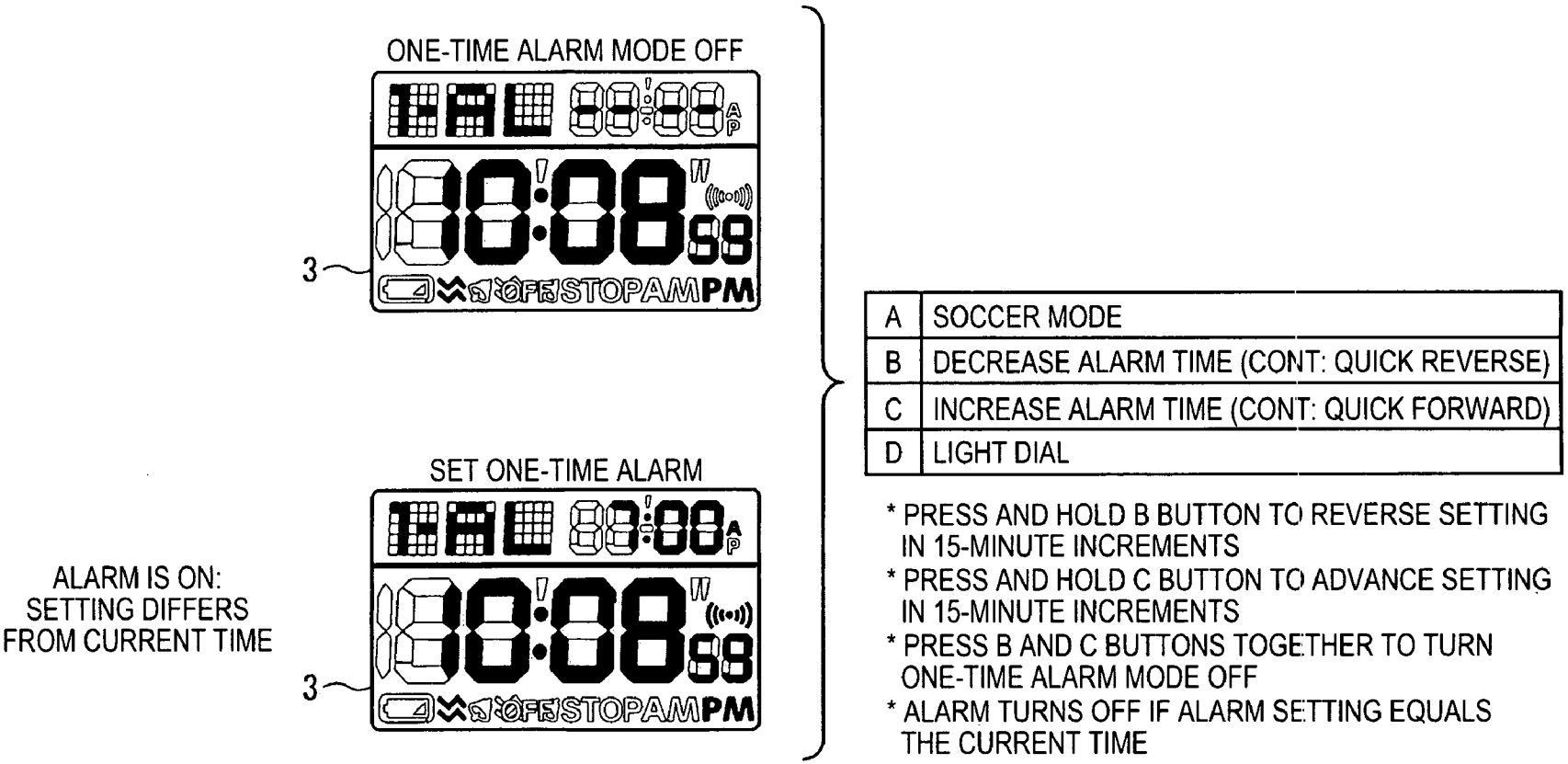
FIG. 13 shows an example of setting a one-time alarm in the first embodiment of the invention.

When the A button 21 is pressed in the time display mode to enter the one-time alarm mode, "1-AL" is displayed in the first display unit 31 to indicate the one-time alarm mode as shown in FIG. 13. The time set for the alarm to sound is also displayed in the second display unit 32. The alarm setting can be changed using the B button 22 and C button 23. More specifically, pressing the B button 22 decrements the alarm time in one minute intervals, and pressing the C button 23 increments the alarm setting in one minute intervals. Pressing and holding the B button 22 reverses the alarm setting in 15-minute increments, and pressing and holding the C button 23 advances the alarm setting in 15-minute increments.

In principle, if the alarm setting is different from the current time, the alarm is turned ON and the one-time alarm icon 34E lights steady. If the alarm setting is the same as the current time, or if the B button 22 and C button 23 are pressed simultaneously, the alarm is turned OFF and the one-time alarm icon 34E also turns off. Pressing the A button 21 cancels the one-time alarm mode and returns to the soccer mode.

Alarm Mode

Pressing the B button 22 in the time display mode cycles the alarm in the order vibration, buzzer, silent, and back to vibration. The alarm is set as shown in Table 1.

TABLE 1

ALARM PATTERNS

| PATTERN | TIMING | VIBRATOR | BUZZER | SILENT |
|---|---|---|---|---|
| KEY OPERATION | KEY SOUND | NONE | H | NONE |
| PATTERN A | KEY INPUT (START/STOP STOPWATCH AND STOPPAGE TIME COUNTER) | L | H | NONE |
| PATTERN B | REMINDER, END OF HALF WHEN THERE IS STOPPAGE TIME (45 MINUTES) | L (3 sec) | H (2 sec) | NONE |
| PATTERN C | END OF PLAY (45 MINUTE PLUS STOPPAGE TIME) | L, L, L | H, H, H | NONE |
| | END OF PLAY (NO STOPPAGE TIME) | L (3 sec) | H (2 sec) | |
| PATTERN D | EVERY 30 SEC WHILE COUNTING STOPPAGE TIME | L, L | H, H | NONE |

* H denotes a high pitch; L denotes a low pitch.

As shown in Table 1, neither the vibrator nor the buzzer is driven regardless of the operation when the alarm is set to the silent mode.

If the alarm is set to vibrate, the vibration icon 34B is displayed in the fourth display unit 34 to indicate that the vibration mode is selected. When the alarm is set to vibrate, vibrations are not produced when the buttons are operated. If the alarm is set to buzzer, the alarm sounds when a button is pressed. This buzzer sounds as a pulse with a pulse width of 31.25 msec in this embodiment of the invention.

When a button is pressed (to start the stopwatch or start and stop counting stoppage time), the alarm is sounded by the vibrator or buzzer using pattern A. When the buzzer sounds in pattern A the buzzer issues a single high-pitched tone which is a pulse signal with a pulse width of 31.25 msec in this aspect of the invention. When the vibrator vibrates in pattern A the vibrator vibrates once with a low-pitched tone that lasts for 250 msec, for example.

When the reminder alarm is set and the first timer 41A reaches the reminder time, or if the playing time for one half is set to 45 minutes and the first timer 41A reaches 45 minutes (the end of first half regulation play) or 90 minutes (the end of second half regulation play), the vibrator or buzzer is driven in pattern B. The pattern B buzzer sounds a continuous high-pitched tone with a pulse width of 2 seconds, for example. The pattern B vibrator vibrates continuously for 3 seconds, for example.

When time is up at the end of the first or second half, either at the end of stoppage time after the end of the half (45 minutes in this example) or at the end of regulation play if no stoppage time is added, the vibrator or buzzer is driven in pattern C. In pattern C the buzzer sounds a pattern such as "pi, pi, pi" followed by a continuous "pi-" for two seconds. More specifically, the buzzer issues a single-shot pulse with a 125 msec pulse width at 3 seconds, 2 seconds, and 1 second before time is up, and sounds continuously for two seconds when time is up at 0 seconds. In pattern C the vibrator vibrates a pattern such as "bu, bu, bu" followed by a continuous "bu-" for three seconds. More specifically, the vibrator vibrates for 375 msec at 3 seconds, 2 seconds, and 1 second before time is up, and vibrates continuously for three seconds when time is up at 0 seconds.

The vibrator or buzzer is driven in pattern D every 30 seconds while stoppage time is being counted. The buzzer sounds the pattern shown in Table 2 once for pattern D. The vibrator vibrates the pattern shown in Table 3 once for pattern D. Note that ⅛ second unit 125 msec.

TABLE 2

BUZZER PATTERNS

| | 1 SECOND | | | | | | | |
|---|---|---|---|---|---|---|---|---|
| TIME | ⅛ | ⅜ | ⅝ | ⅞ | ⅛ | ⅜ | ⅝ | ⅞ |
| ON/OFF | on | on | on | on | on | on | on | on |
| FREQUENCY (Hz) | 4096 | 4096 | 4096 | 4096 | 4096 | 4096 | 4096 | 4096 |
| VOLUME (LEVEL) | 1 | 1 | 1 | 1 | 1 | 1 | 1 | 1 |

TABLE 3

VIBRATION PATTERNS

| | 1 SECOND | | | | | | | |
|---|---|---|---|---|---|---|---|---|
| TIME | ⅛ | ⅜ | ⅝ | ⅞ | ⅛ | ⅜ | ⅝ | ⅞ |
| ON/OFF | on | on | on | | | on | on | on |

This first embodiment of the invention affords the following benefits.

(1) The user can easily know how much time has passed since the stopwatch started because the first timer 41A measures the elapsed time by counting up. Stoppage time can also be counted separately while continuing to count the match time because a second timer 41B is provided to complement the first timer 41A. The referee in a soccer match, for example, can thus efficiently keep both match time and stoppage time, thus making the referee's job easier.

(2) Furthermore, because the first timer 41A and second timer 41B simultaneously and separately count the match time and stoppage time, the end of play including stoppage time can be automatically reported when the time kept by the first timer 41A reaches the end of regulation play plus the stoppage time counted by the second timer 41B (so that, for example, if each half is 45 minutes and stoppage time of 9:21 is counted, the end of play is reported when the first timer 41A counts to 54:21). The referee therefore does not need to manually manage playing time by adding stoppage time to the game time, the referee's job is thus made easier, and the end of play can be reliably signalled.

(3) Using the second timer 41B to count stoppage time while the first timer 41A is keeping the match time is as simple as pressing the C button 23 once to start counting stoppage time and pressing the C button 23 again to stop counting stoppage time. Furthermore, by using a separate second timer 41B to keep the stoppage time, stoppage time can be kept cumulatively by simply pressing the C button 23 when stoppage time occurs more than once during a single match.

(4) By sounding a warning alarm every 30 seconds while keeping stoppage time, the referee can be prevented from forgetting to stop the stoppage time counter and stoppage time can therefore be kept accurately.

(5) Each referee can choose the type of alarm that is personally preferred because the alarm can be selectively set to operate using an audible buzzer or a vibrator. In addition, by setting the alarm to the vibrator mode when spectator cheering and other sounds can make the audible alarm difficult to hear, the alarm can be reliably recognized by the referee.

(6) By enabling four different alarm patterns A to D and reporting different events with different alarm patterns, the referee can easily know what event is being reported without looking at the timekeeping device 1. The referee can therefore concentrate on the match, and the referee's job can be made easier.

(7) By providing a battery icon 34A, the referee can easily verify the battery voltage (condition) before the match, and problems caused by the battery going dead in the middle of play can be prevented.

(8) The match time can also be set easily because pressing the B button 22 when in the soccer mode rapidly advances the match time setting in 5 minute increments.

(9) The second half standby mode and first half standby mode can be easily set by simply pressing and holding the A button 21. This also helps to make the referee's job easier.

(10) Both the first timer 41A and second timer 41B are started using the C button 23, and pressing the C button 23 when the first timer 41A is not running starts the first timer 41A while pressing the C button 23 while the first timer 41A is running starts the second timer 41B. Ease of use is thus improved because the referee always presses the same C button 23 to start the timer. The likelihood of accidentally stopping the first timer 41A is also greatly reduced and match time can be more reliably counted because the first timer 41A, which normally does not require stopping until the first half or second half ends, is stopped by pressing and holding the B button 22, an operation that requires purposeful action by the referee. The second timer 41B can also be easily stopped by simply pressing the C button 23 again. The referee therefore only needs to press the C button 23 during the match, and ease of use is thus improved because the need to press any other buttons is prevented.

(11) The current time is displayed in the second display unit 32 when in the first half and second half standby modes so that when the match is scheduled to start at a specific time the start of the match can be easily controlled by watching the current time on the stopwatch.

(12) The reminder alarm can be easily set to 3 minutes, 5 minutes, or 7 minutes so that the referee can easily select the desired reminder time and convenience is improved.

Second Embodiment

Figure 14:
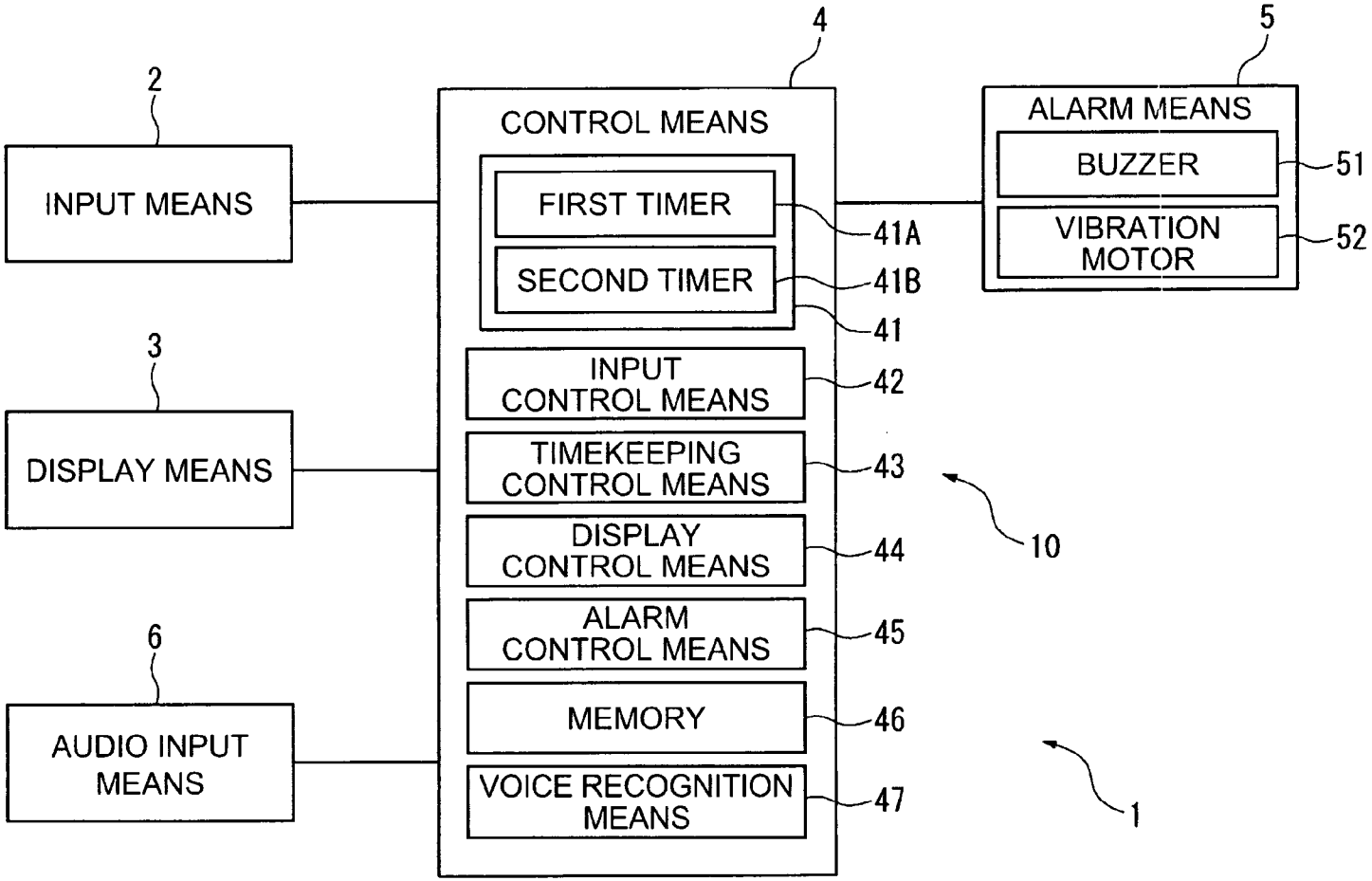
FIG. 14 is a block diagram of a timekeeping device according to a second embodiment of the invention.
Figure 15:
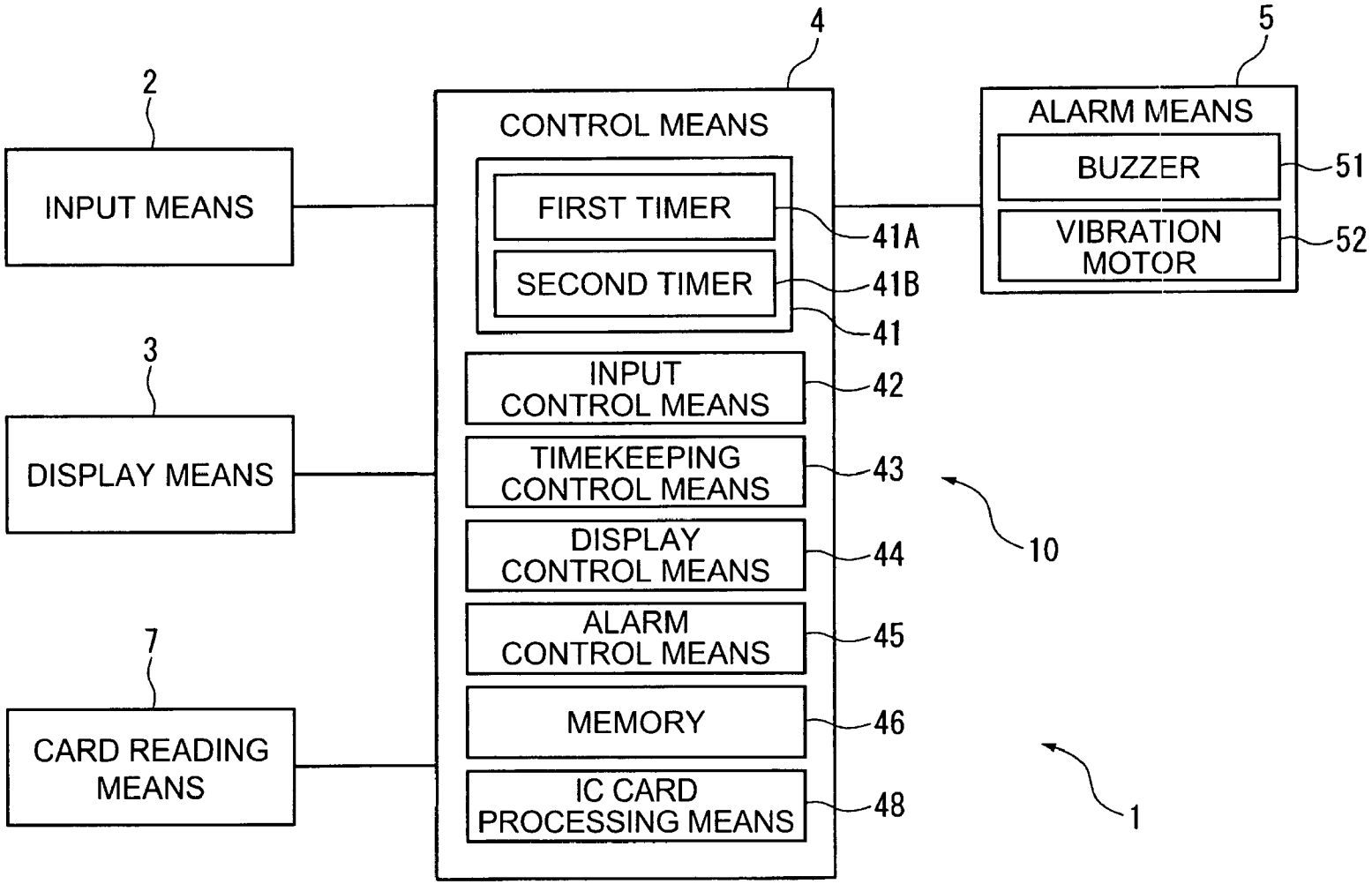
FIG. 15 is a block diagram of a timekeeping device according to a third embodiment of the invention.

A timekeeping device 1 according to a second embodiment of the invention is described next with reference to FIG. 14. Like parts in this and the preceding embodiment are identified by like reference numerals and further description thereof is omitted.

The timekeeping device 1 according to this second embodiment of the invention additionally has an audio input unit 6 such as a microphone for audibly inputting information, and a voice recognition unit 47 for recognizing and converting the audible commands input through the audio input unit 6 to corresponding button operations.

When certain predetermined words such as "start match," "stop match," start stoppage time," and "stop stoppage time" are spoken into the audio input unit 6, the voice recognition unit 47 converts the words to signals corresponding to specific button operations such as pressing the C button 23 to start the match, pressing and holding the B button 22 to stop the match, and pressing the C button 23 to start and stop the stoppage time timer. The voice recognition unit 47 then inputs these signals to the input control unit 42 to control the control unit 4 in the standby mode in the same way as if the corresponding buttons had been pressed.

Other information such as the team name, jersey number, and rule violation (such as a yellow card or red card) could also be audibly input to record which players received what penalties.

In addition to the benefits afforded by the first embodiment described above, this embodiment of the invention further improves ease of use by enabling the referee to operate the stopwatch by voice instead of by pressing buttons.

Furthermore, by enabling audibly recording penalties, the referee no longer needs to keep a written log and the referee's job is thus made easier.

Third Embodiment

A timekeeping device 1 according to a third embodiment of the invention is described next. The timekeeping device 1 according to this third embodiment of the invention additionally has a card reading unit 7 such as a card reader for reading IC cards, for example, and an IC card processing unit 48 for recognizing and converting information input from the card reading unit 7 to corresponding button actions.

If the yellow and red penalty cards are rendered as IC cards and one of the cards is swiped over the card reading unit 7, the IC card processing unit 48 automatically recognizes the card and records the penalty card together with the match time when the penalty occurred. Information (such as the team name and jersey number) identifying the player that received the penalty can also be input using keys, audibly, or visually (such as by taking a picture of the player if the timekeeping device 1 has a camera function).

In addition to the benefits afforded by the first and second embodiments described above, this third embodiment of the invention further improves case of use by enabling the referee to record penalties by simply swiping a card.

The recorded data can be displayed on the display unit 3 in the second and third embodiments of the invention. More specifically, the display unit 3 can simply display information representing the time that a penalty occurred, the team, the jersey number, and the penalty (yellow card or red card). This information can be displayed as text, using a code, or using a two-dimensional QR Code (R). If the information is displayed using a code, the data can be sent to or displayed by another device such as a cell phone or personal computer by simply reading the code. The data could also be sent to a personal computer or other device or even printed from a printer through a wired or wireless connection with the timekeeping device 1.

The present invention is not limited to these embodiments and can be varied in many ways without departing from the scope of the present invention. For example, the second half timer starts from the end of the first half playing time (such as 45 minutes), but the display of the second half timer could start from 0:00, for example. Starting the second half timer from the end of the regulation time of the first half makes it easy to know how much time has passed since the beginning of the match (since the first half started) even during the second half. Starting the second half timer from 0:00, on the other hand, enables easily knowing how much time has passed in just the second half. By enabling this selection, the referee that is using the timekeeping device 1 can select the preferred display mode and ease of use is thus improved.

When the second half starts from the end of first half play, the same elapsed time will be displayed at the end of the stoppage time added to the first half and after the second half starts. For example, if stoppage time was added to the first half and the first half was extended 5 minutes, the third display unit 33 will indicate 50 minutes at the end of the first half. When the second half timer then starts at 45 minutes, the third display unit 33 will also indicate 50 minutes after five minutes of play in the second half. This is not usually a problem because the referee knows whether it is currently the first half or second half, but a plus sign "+" could also be displayed when the displayed time includes time added for stoppage time. In this case displaying "50+" tells the user that the display shows the time including time added for stoppage time in the first half, while displaying "50" tells the user that the second half is in progress.

The timekeeping device 1 can also have a radio-controlled timekeeping function for receiving a standard time signal and automatically adjusting the current time setting. If the timekeeping device 1 has this function the current time can be reliably displayed, matches can be started on time without delay when the starting time is specified, and the match can be easily started on time in conjunction with live television broadcasting.

The alarm can also be selectively set to a vibrator mode or buzzer mode above, but a mode that simultaneously drives the vibrator and buzzer can also be provided. A mode that uses a flashing light or lighting pattern can also be provided.

The timekeeping device 1 can also be rendered with both the audio input unit 6 and voice recognition unit 47 described in the second embodiment and the card reading unit 7 and IC card processing unit 48 described in the third embodiment.

The various parts of the control unit 4 are rendered by incorporating a computer having a CPU and memory in the timekeeping device 1 and causing the computer to run a predetermined program to render the various parts of the control unit 4, but the invention is not so limited and can be rendered using a hardware construction of various logic elements. However, if a CPU and memory are disposed in the timekeeping device 1 to function as a computer, the predetermined control program and data are installed to this internal memory from the Internet or other network using a communication unit or from a recording medium such as a CD-ROM or memory card, and the CPU runs the installed program to render the various parts of the control unit 4, the functionality of the timekeeping device 1 can be changed by simply changing the program, and the desired program can be installed when the product is shipped from the factory or later as desired by the user.

Because timekeeping devices 1 with different control functions can be provided by simply changing the control program in this case, common parts can be used in a wider range of products and the cost of manufacturing a variety of different products can be greatly reduced.

A particular program can be installed in the timekeeping device 1 by directly inserting a memory card or CD-ROM, for example, to the timekeeping device 1, or a suitable media reader can be externally connected to the timekeeping device 1 for communication. The program can also be installed by communication with the timekeeping device 1 via a LAN cable or telephone line, for example. An antenna could also be provided so that the program can be installed by wireless communication.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The entire disclosure of Japanese Patent Application No. 2006-28029, filed Feb. 6, 2006 is expressly incorporated by reference herein.

What is claimed is:

1. A timekeeping device comprising:

a first timer for starting timekeeping in response to a user operation, keeping time by counting up, and stopping timekeeping in response to a stop operation by the user;

a second timer for starting timekeeping in response to a start operation by the user while the first timer is keeping time, keeping time by counting up, and stopping timekeeping in response to a stop operation by the user;

a display unit for displaying the times kept by the first timer and the second timer; and an alarm unit for issuing at least a first alarm and a second alarm;

wherein the alarm unit issues the first alarm when the second timer is keeping time and the time kept by the first timer reaches a preset set time, and issues the second alarm when the second timer is not keeping time and the time kept by the first timer reaches a preset set time, and when the second timer is keeping time and the time kept by the first timer reaches a time equal to the preset set time plus the time kept by the second timer.

2. The timekeeping device described in claim 1, further comprising:

an input unit that is operated by the user;

and a control unit having a timekeeping unit including the first timer and the second timer;

an input control unit for detecting input to the input unit;

a timekeeping control unit for controlling driving the first timer and the second timer based on input from the input control unit;

a display control unit for controlling driving the display unit;

an alarm control unit for controlling driving the alarm unit; and a storage unit for storing at least the set time that is set by input to the input unit;

wherein the alarm control unit controls driving the alarm unit to output the first alarm when the second timer is keeping time and the time kept by the first timer reaches a preset set time, and controls driving the alarm unit to output the second alarm when the second timer is not keeping time and the time kept by the first timer reaches a preset set time, and when the second timer is keeping time and the time kept by the first timer reaches a time equal to the preset set time plus the time kept by the second timer.

3. The timekeeping device described in claim 1 or 2, wherein:

the first timer can keep a preset first half playing time and a second half playing time, starts counting the first half playing time from 0 minute 0 second, and starts counting the second half playing time from the first half playing time.

4. The timekeeping device described in claim 1 or 2, wherein:

the alarm unit enables selecting whether the alarm is output from a buzzer or a vibrator.

5. The timekeeping device described in claim 1 or 2, wherein:

the alarm unit outputs an alarm when the time kept by the first timer reaches a predetermined time before the set time.

6. The timekeeping device described in claim 1 or 2, further comprising:

a voice input unit for voice input; and a voice recognition unit for recognizing the voice input;

wherein starting and stopping timekeeping by the timers is based on voice input.

7. The timekeeping device described in claim 1 or 2, further comprising:

a voice input unit for voice input; and a voice recognition unit for recognizing the voice input;

wherein when a team name, player jersey number, and penalty type are input by voice input, the information input by voice is stored together with the time indicated by the first timer when the voice input was detected.

8. The timekeeping device described in claim 1 or 2, further comprising:

a card reading unit for reading an IC card;

wherein the time indicated by the first timer when a predetermined card is read is stored together with the card information when the predetermined card is read.

* * * * *